US007922887B2

(12) United States Patent
Haba et al.

(10) Patent No.: US 7,922,887 B2
(45) Date of Patent: Apr. 12, 2011

(54) METAL STRUCTURE AND METHOD OF ITS PRODUCTION

(75) Inventors: Toshio Haba, Naka (JP); Hiroshi Yoshida, Mito (JP); Haruo Akahoshi, Hitachi (JP); Hitoshi Suzuki, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/340,570

(22) Filed: Jan. 27, 2006

(65) Prior Publication Data

US 2006/0180472 A1 Aug. 17, 2006

(30) Foreign Application Priority Data

Jan. 27, 2005 (JP) ..... 2005-019395

(51) Int. Cl.
*C25D 5/16* (2006.01)
*C25D 5/02* (2006.01)

(52) U.S. Cl. ..... 205/95; 205/118

(58) Field of Classification Search ..... 205/95, 205/118, 136, 149, 183
See application file for complete search history.

(56) References Cited

U.S. PATENT DOCUMENTS 5,527,734 A 6/1996 van der Putten et al.
5,631,119 A * 5/1997 Shinozaki ..... 430/326
6,245,676 B1 6/2001 Ueno
6,287,950 B1 9/2001 Wu et al.
6,316,059 B1 11/2001 van der Putten et al.
6,326,556 B1 12/2001 Asai et al.
6,387,807 B1 * 5/2002 Faubert et al. ..... 438/687
6,511,588 B1 1/2003 Kobayashi et al.
6,553,662 B2 4/2003 Sedberry
6,825,541 B2 11/2004 Huang et al.
7,144,490 B2 * 12/2006 Cheng et al. ..... 205/118
2002/0084191 A1 * 7/2002 Haba et al. ..... 205/125
2003/0178547 A1 * 9/2003 Wang et al. ..... 249/187.1
2004/0066732 A1 4/2004 Takemoto et al.
2004/0134786 A1 * 7/2004 Chiang et al. ..... 205/67
2005/0045488 A1 * 3/2005 Paneccasio et al. ..... 205/291
2005/0087447 A1 4/2005 Haba et al.

(Continued)

FOREIGN PATENT DOCUMENTS

JP 03-256603 11/1991

(Continued)

OTHER PUBLICATIONS

Anisotropic Deposition of Electroless Nickel; J. Electrochem. Soc.; vol. 140, No. 8; Aug. 1993.

(Continued)

*Primary Examiner* — Luan V Van
(74) *Attorney, Agent, or Firm* — Antonelli, Terry, Stout & Kraus, LLP.

(57) ABSTRACT

The present invention provides a method for producing a metal structure comprising a substrate and a metal film formed on the substrate; comprising the steps of providing surface having irregularities made of a electrical conductor in the area of the substrate where the metal body or film is to be formed; and preferentially forming the metal body or film by electroplating in the area provided with the conductive surface having irregularities. The plating bath may preferably contain an additive compound such as a cyanine dye which is capable of suppressing the plating reaction, and which loses such plating-suppressing effect with the progress of the plating reaction. The metal film can be produced by electroplating in the area provided with the surface having irregularities.

28 Claims, 11 Drawing Sheets

U.S. PATENT DOCUMENTS

2005/0089671 A1 4/2005 Kubota

FOREIGN PATENT DOCUMENTS

| | | | |
|---|---|---|---|
| JP | 4-234126 | | 8/1992 |
| JP | 05-334163 | | 12/1993 |
| JP | 07-198918 | | 8/1995 |
| JP | 7-336018 | | 12/1995 |
| JP | 09-063756 | | 3/1997 |
| JP | 10-012545 | | 1/1998 |
| JP | 10-338213 | | 12/1998 |
| JP | 11-238703 | A | 8/1999 |
| JP | 2000-158157 | | 6/2000 |
| JP | 2000-248397 | | 9/2000 |
| JP | 2002-184752 | | 6/2002 |
| JP | 2003-243399 | | 8/2003 |
| JP | 2003-247097 | | 9/2003 |
| JP | 2004-200699 | | 7/2004 |
| JP | 2004-263202 | | 9/2004 |
| JP | 2005-50965 | | 2/2005 |
| JP | 2005-51151 | | 2/2005 |
| JP | 2006-210565 | | 8/2006 |
| WO | WO 03/009361 | A2 | 1/2003 |
| WO | WO 03/088396 | A1 | 10/2003 |

OTHER PUBLICATIONS

Structural Evolution of Electroless Nickel Bump; Journal of the Electrochemical Society; 150(5) C273-C276; 2003.

Zashchita Metallov (1972), 8(3), pp. 338-342.

Andre M.T. van der Putten et al., "Anisotropic Deposition of Electroless Nickel", vol. 140, No. 8, Aug. 1993, pp. 2229-2235.

Kwang-Lung Lin et al., "Structural Evolution of Electroless Nickel Bump", 150(5), C273-C276 (2003).

JP Office Action of Application 2005-019395 dated Aug. 21, 2009 with English translation.

JP Office Action of Application 2005-019395 dated Sep. 1, 2009 with English translation.

* cited by examiner

METAL STRUCTURE AND METHOD OF ITS PRODUCTION

CROSS REFERENCE TO A RELATED APPLICATION

This application is related to U.S. patent application Ser. No. 11/205,175, filed Aug. 17, 2005.

CLAIM OF PRIORITY

This application claims priority from Japanese application Serial No. 2005-019395, filed on Jan. 27, 2005, the content of which is hereby incorporated by reference into this application.

FIELD OF THE INVENTION

This invention relates to a method for producing a metal structure comprising a substrate and a metal body or film formed on the substrate. The metal structure of the present invention is adapted for use in producing, for example, an optical component such as a reflector, stamper used as a mold, a contact probe, a heat exchanger, heatsink, etc.

BACKGROUND OF THE INVENTION

Electronic devices and optical components use a metal structure comprising a substrate and a patterned metal body or film. Several patterning methods are known for forming the predetermined pattern, and representative methods include the one using a photoresist, the one using contact printing, the one using ink jet printing, and the one using scanning probe microscope.

In a representative method, irregularity-forming layers having different etching speed and a resist pattern are disposed on the substrate and a structure having surface irregularities is formed by photolithographic and etching process (see, for example, Japanese Published Unexamined Patent Application No. Hei 7-198918). Another method known in the art is a method wherein a metal structure is formed by forming a layer of resist material on the surface of an article, forming a self-assembled monolayer on the layer of resist material by using a large-area stamp, etching the layer of resist material, and etching or plating the surface of the article (see, for example, Japanese Published Unexamined Patent Application No. Hei 10-12545).

Also known is a method wherein fine grooves or pits having an opening of 5 to 100 μm are formed at a regular interval by laser beam irradiation (see, for example, Japanese Published Unexamined Patent Application No. 2000-158157).

The photolithographic process requires quite a number of steps such as formation of the resist film, exposure, development, and the like and this invites an increased cost of the apparatus and chemicals used, and use of a large quantity of chemicals invites risk of environmental pollution by the discarding of the used chemicals.

The etching using a resist film is associated with the problems of an increased cost by the use of the resist film and the environmental pollution due to the discarding of the chemicals used in the process.

The method of irradiating the laser beam has the problem that a long time is required in the case of a structure having a large surface area since the area irradiated by the laser beam is limited.

In view of the situation as described above, an object of the present invention is to provide a method for producing a metal structure which is capable of forming a metal film of predetermined fine pattern in a reduced number of steps. Another object of the present invention is to provide a metal structure produced by such method.

SUMMARY OF THE INVENTION

The present invention provides a method for producing a metal structure comprising a substrate and a metal body formed on the substrate; comprising the steps of:

providing an electrical conductor with a surface having irregularities in a selected area of the substrate; and forming the metal body or film by electroplating on the surface having irregularities in the selected area of the electrical conductor. The method is preferably carried out by means of an electro plating bath containing a substance for increasing deposition overpotential of metal to be plated. The metal to be plated is preferentially plated on the surface with the irregularities of the electrical conductor. The word "preferentially" is used to mean that a thickness of the plating is accelerated in the area of the surface with irregularities.

The present invention also provides a metal structure comprising a substrate and a metal film formed on the substrate, wherein the part underneath the metal film is formed from an electrical conductor, a surface with irregularities is formed on at least a part of the electrical conductor, and the metal body or film is formed by electroplating using an electro plating bath containing a substance for increasing deposition overpotential of metal in the area provided with a surface with irregularities.

The present invention enables formation of a metal body or film of predetermined fine pattern in a reduced number of steps.

DETAILED DESCRIPTION OF THE PREFERRED EMBODIMENTS

Figure 1A:
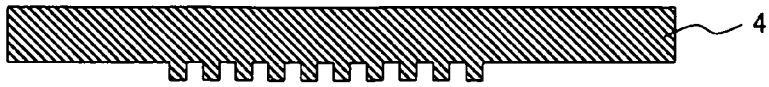
FIGS. 1A to 1E are cross sectional and perspective views showing the production method of the metal structure according to the present invention.

The inventors of the present invention found that when surface irregularities are formed on the electrical conductor film serving the power supply layer, and electroplating is conducted by using a plating bath having an appropriate additive added thereto, a metal can be preferentially deposited in the area formed with such surface irregularities. In order to facilitate the preferential growth of the plated film of predetermined pattern in the area provided with the surface having irregularities, the plating bath may preferably contain an additive compound which is capable of suppressing the plating reaction, and which loses such plating-suppressing effect with the progress of the plating reaction. The property of suppressing the plating bath can be confirmed by the increase of the metal deposition overpotential by the introduction of the additive. The property of losing the plating-suppressing effect with the progress of the plating reaction can be confirmed by the increase of the metal deposition overpotential with increase in the flow rate of the plating bath, namely, with increase in the supply rate of the additive to the electrical conductor surface. When the additive is decomposed to lose the plating-suppressing effect, the additive may be decomposed into different substance, or converted into a different substance having a different oxidation number.

When the plating is conducted by using a plating bath containing such an additive, effective concentration of the additive reduces with the progress of the plating reaction since the additive loses its effect on the surface of the electrical conductor. The area formed with the surface irregularities has a surface area relatively greater than that of the area with no surface irregularities, and therefore, the additive reduces at a faster rate in such area, and the concentration of the additive near the electrical conductor surface would be low. As a consequence, the effect of adding the substance which suppresses the plating reaction becomes less eminent in the area of the electrical conductor surface with the surface irregularities, and the plating progresses preferentially in the area formed with the surface irregularities compared to the area with no such surface irregularities.

The phenomenon as described above is realized by the balance between diffusion of the additive onto the electrical conductor and the reaction on the electrical conductor surface. The diffusion rate of the additive onto the electrical conductor is greatly affected by the concentration of the additive in the plating bath, and the reaction rate of the additive on the electrical conductor is greatly affected by the current density in the plating. Accordingly, concentration distribution of the additive can be controlled by changing these parameters, and preferential growth in the area provided with the surface having irregularities is thereby enabled.

Next, the metal structure production method of the present invention is described in further detail by referring to various embodiments.

In one method, the substrate is formed from a electrical conductor, and the surface irregularities are formed on at least a part of the electrical conductor substrate, and the metal film is preferentially formed in such an area formed with the surface irregularities.

In another method, the substrate is formed from a electrical conductor, surface irregularities are formed on the electrical conductor substrate, and the surface irregularities in the area other than the area where the metal film is to be formed is flattened. The metal film is then formed in the area having the surface irregularities.

In another method, the substrate is formed from an electric insulator, surface irregularities are formed on the electric insulator substrate where the metal film is to be formed, a electrical conductor is formed on the electric insulator substrate with the shape of the surface irregularity maintained, and a metal film is then preferentially formed in the area where the surface irregularities are provided on the electrical conductor.

In another method, the substrate is formed from an electric insulator, surface irregularities are formed on the electric insulator substrate, a electrical conductor is formed on the electric insulator substrate with the shape of the surface irregularity maintained, the area where the metal film is not to be formed is flattened, and electroplating is then conducted.

In another method, a metal body or film is preferentially formed by electroplating on the surface having irregularities of the substrate, and the metal body or film formed in the selected area other than the area of surface having irregularities is then removed.

In another method, wherein the substrate is formed from an electric insulator, the surface having irregularities is formed on a part of the electric insulator substrate, a electrical conductor is formed on the electric insulator substrate with the shape of the surface irregularity maintained, a metal film is formed by electroplating on the electrical conductor, and the metal film and the electrical conductor in the area where the surface irregularities are absent are removed.

In order to preferentially form the metal body or film by electroplating on a predetermined area of the substrate, the area where the metal body or film is to be formed should be formed from a electrical conductor. When the substrate is formed from an electric insulator and not the electrical conductor, an electrical conductor layer should be formed on the electric insulator substrate.

In order to form the metal film of predetermined pattern on the electrical conductor by electroplating, the area where the pattern is formed should be provided with surface irregularities. The plated film will then be preferentially formed on the area formed with the surface irregularities, and formation of the metal film in the predetermined pattern would be thereby enabled. Roughness of the surface irregularities should be within an appropriate range, and the metal film will be plated in the area having the surface irregularities when the surface roughness are appropriate. The area provided with the surface irregularities may preferably have an arithmetic average roughness Ra defined by JIS B0601:2001 (hereinafter JIS B0601), which is larger than that of the area provided with no surface irregularities. The area provided with the surface irregularities may also have a mean spacing of the profile elements RSm also defined by JIS B0601, which is smaller than that of the area provided with no surface irregularities. The area provided with the surface irregularities may preferably have an arithmetic average roughness Ra defined by JIS B0601 of 0.01 to 4 μm, and a mean spacing of the profile elements RSm also defined by JIS B0601 of 0.005 to 8 μm. Ra is most preferably 0.1 to 1 μm, and RSm is most preferably 0.05 to 2 μm.

In order to preferentially form the metal film on the surface irregularities, introduction of an adequate additive in the plating bath is also important. In the present invention, the plating bath may preferably have added thereto at least one substance which increases deposition overpotential of the metal to be plated. Particularly preferred is the addition of a substance which increases the deposition overpotential of the metal to be plated such that the deposition overpotential is higher after increasing the flow rate of the plating bath compared to that before increasing the flow rate. An example of the substance having such function is cyanine dye. The cyanine dye is preferably a compound represented by the following chemical structure:

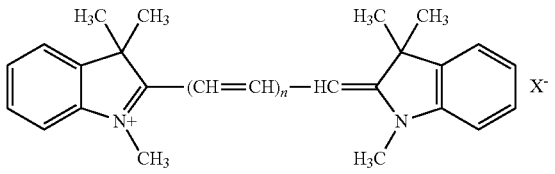

wherein X is an anion, and n is 0, 1, 2, or 3.

The present invention exhibited remarkable effects in the electroplating of copper or an alloy thereof.

As described above, a flattening treatment is conducted in one embodiment of the present invention to thereby erase the surface irregularities formed in the area where the metal film is not to be formed. In such flattening treatment, the surface irregularities are preferably flattened such that, when the surface irregularities has a surface roughness as represented by the arithmetic average roughness Ra defined by JIS B0601 of 0.01 to 4 μm, the flattening treatment is conducted until the Ra is 0 to 0.005 μm. When the surface irregularities has a surface roughness as represented by the mean spacing of the profile elements RSm also defined by JIS B0601 of 0.005 to 8 μm, the flattening treatment is conducted until the RSm is 10 to 100 μm. When the surface irregularities has a surface roughness as represented by the arithmetic average roughness Ra defined by JIS B0601 of 0.1 to 1 μm, the flattening treatment is conducted until the Ra is 0 to 0.05 μm, and when the surface irregularities has a surface roughness as represented by the mean spacing of the profile elements RSm also defined by JIS B0601 of 0.05 to 2 μm, the flattening treatment is conducted until the RSm is 4 to 40 μm.

In the present invention, the ratio (T/t) of the thickness (T) of the metal film formed by electroplating in the area provided with the surface irregularities to the thickness (t) of the metal film formed in the area having no surface irregularities can be increased to not less than 1, not less than 10, or not less than 100.

The metal structure comprising the electrical conductor and the metal film of predetermined pattern formed on the electrical conductor wherein the ratio T/t is not less than 1, and not less than 10 can be used as a reflector of an optical component, or as a heat exchanger. Such metal structure can also be used as an inspection probe or as a mold stamper.

Next, various embodiments of the present invention are described by referring to the drawings. The results of the Examples and the Comparative Examples are summarized in Table 4.

EXAMPLE 1

Figure 1B:
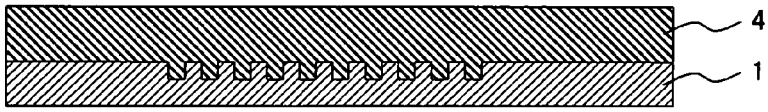
Figure 1C:
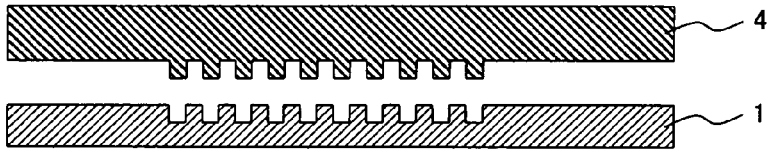
Figure 1D:
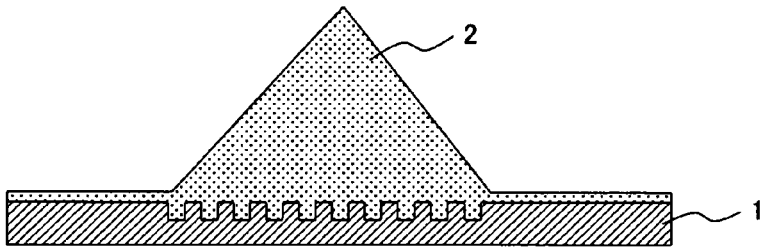
Figure 1E:
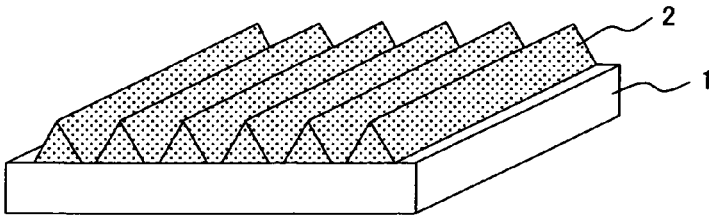

A silicon mold 4 has a wiring pattern with a width of 50 μm formed at an interval of 5 μm as shown in FIG. 1A, and each wiring pattern has trenches having a width of 300 nm and a height of 600 nm formed at an interval of 300 nm. As shown in FIG. 1B, a electrical conductor substrate 1 in the form of a nickel film was formed on this silicon mold 4 by electroless plating. After the plating, the nickel film was peeled off the silicon mold 4 as shown in the FIG. 1C. The surface having irregularities on the nickel film after peeling off the silicon mold was observed, and the shape of the surface irregularities of the mold 4 was found to be maintained on the nickel film. Next, the electrical conductor substrate 1 comprising the nickel film was fixed in a jig for electroplating, and the conductor substrate 1 was electroplated to form a metal film 2 having a particular pattern on the electrical conductor substrate 1 as shown in FIG. 1D in exploded view and in FIG. 1E in perspective view. Although the electrical conductor substrate 1 is depicted in FIG. 1E to be partly left uncovered by the metal film 2, the entire surface of the electrical conductor substrate 1 is actually covered by the metal film 2, and the metal film 2 on the part formed with the surface irregularities is thicker than other parts. The electroplating was conducted by using a plating bath having the composition shown in Table 1. The additive used was 2-[3-(1,3-Dihydro-1,3,3-trimethyl-2H-indol-2-ylidene)-1-pro penyl]-1,3,3-trimethyl-3H-indolium chloride.

TABLE 1

| Component | Concentration (g/dm$^3$) |
|---|---|
| Copper sulfate pentahydrate | 64 |
| Sulfuric acid | 180 |
| Chloride ion | $70 \times 10^{-3}$ |
| Additive | $7 \times 10^{-3}$ |

The electroplating was conducted by using a plating time of 20 minutes, a current density of 1.3 A/dm$^2$, a plating bath temperature of 25° C., and by using a phosphorus-containing copper plate for the anode. When the cross section of the substrate was observed after the electroplating, the metal film 2 after the plating, namely, the copper film had a maximum thickness of 35 μm in the area provided with the surface irregularities, and 0.45 μm in the area provided with no surface irregularities, and the ratio H1/H2 of the film thickness shown in FIG. 12 was 78. As indicated by such results, a metal structure having a metal film preferentially formed in the area provided with the surface irregularities could be produced.

EXAMPLE 2

Figure 2A:
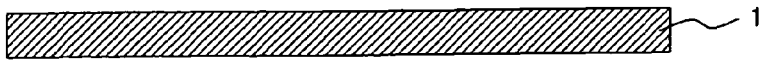
FIGS. 2A to 2E are cross sectional, top, and perspective views showing the production method of the metal structure according to another embodiment of the present invention.
Figure 2B:
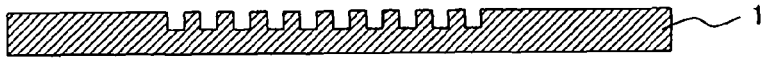
Figure 2C:
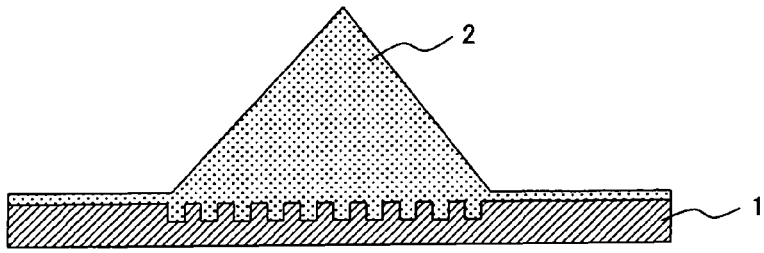

A copper foil having a thickness of 1 mm was used for the electrical conductor substrate 1 as shown in FIG. 2A. Surface irregularities were then formed on the copper foil by surface roughening as shown in FIG. 2B. Sand blast was used for the surface roughening by blasting alumina fine particles to the copper surface through a mask pattern of 100 μm squares. The roughened copper foil surface was evaluated for the surface roughness of the surface irregularities with a surface roughness measuring apparatus. Arithmetic average roughness Ra defined by JIS B0601 was 0.4 μm, and mean spacing of the profile elements RSm also defined by JIS B0601 was 1.1 μm. After the roughening of the copper surface, the surface was electroplated to form a metal film 2 comprising the electroplated film of copper as shown in FIG. 2C. The electroplating was conducted by using the composition of the plating bath and the plating conditions which were the same as those of the procedure of Example 1 except that the plating time was 25 minutes and the current density was 0.5 A/dm$^2$.

Figure 2D:
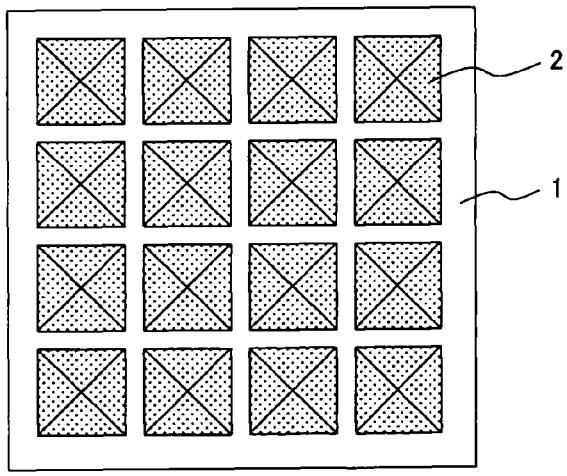
Figure 2E:
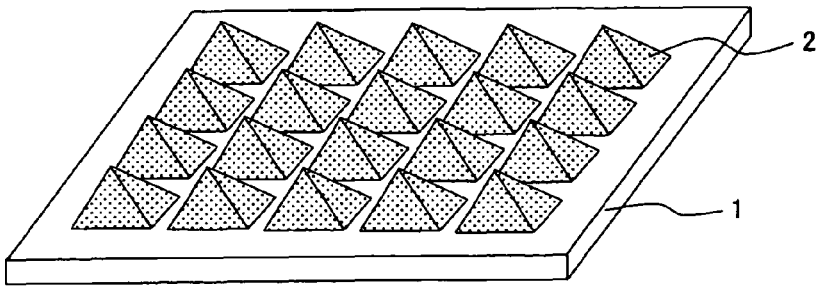
Figure 12:
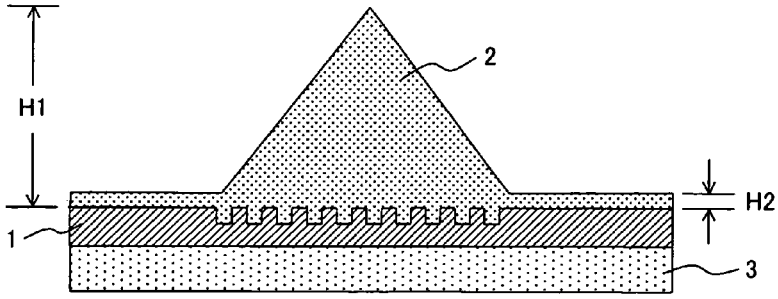
FIG. 12 is a view presented to explain the method used for evaluating the film thickness of the part plated with the metal structure.

When the cross section of the substrate was observed after the electroplating, the maximum thickness of the plated copper film in the area formed with the surface irregularities was 15 μm, and the maximum film thickness of the area formed with no surface irregularities was 0.1 μm, and the ratio H1/H2 of the film thickness shown in FIG. 12 was 150. As indicated by such results, a metal structure having a metal film preferentially formed in the area provided with the surface irregularities could be produced as shown in FIGS. 2D and 2E. Although the electrical conductor substrate 1 is depicted in FIGS. 2D and 2E to have been only partly covered by the metal film 2, the metal film was actually formed on the entire surface of the electrical conductor substrate 1, and the metal film of the part formed with the surface irregularities was thicker than other parts, as shown in FIG. 2C.

EXAMPLE 3

Figure 3A:
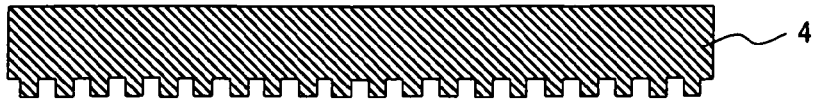
FIGS. 3A to 3E are cross sectional views showing the production method of the metal structure according to a further embodiment of the present invention.
Figure 3B:
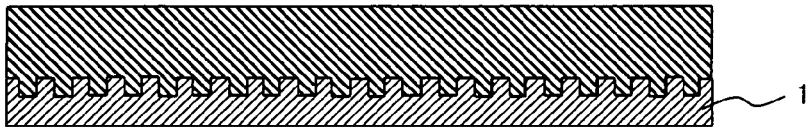
Figure 3C:
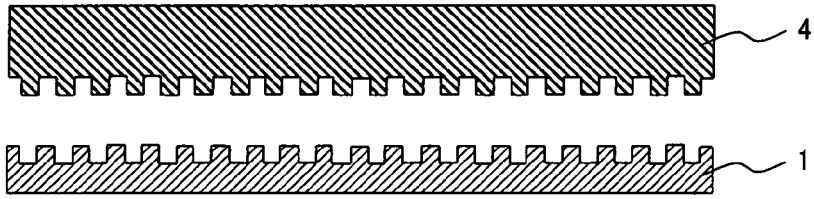

In this Example, the mold 4 used was a titanium plate as shown in FIG. 3A having a surface irregularity pattern with a width of 10 μm having an arithmetic average roughness Ra defined by JIS B0601 of 0.05 μm, and a mean spacing of the profile elements RSm also defined by JIS B0601 of 0.04 μm. A copper film was formed on this titanium plate by electroplating as shown in FIG. 3B for use as the electrical conductor substrate 1. After the electroplating, the copper film was peeled off the mold 4 as shown in FIG. 3C to use the film for the electrical conductor substrate. Surface irregularities of the copper film after peeling off the mold 4 was observed. The surface irregularities had an arithmetic average roughness Ra defined by JIS B0601 of 0.05 μm, and mean spacing of the profile elements RSm also defined by JIS B0601 of 0.04 μm, indicating that the surface configuration of the mold 4 had been maintained by the copper film.

Figure 3D:
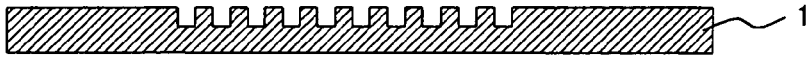
Figure 3E:
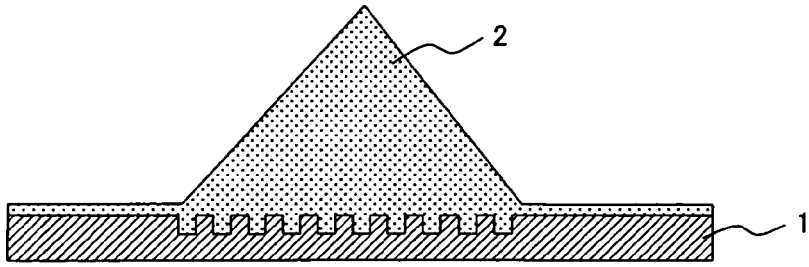

Next, as shown in FIG. 3D, a suspension of copper fine particles was printed to cover the area where the surface irregularities were not to be formed, and annealing was conducted in vacuum at 300° C. for 30 minutes to flatten some parts of the electrical conductor substrate as shown in FIG. 3D. The part covered with the copper fine particles was evaluated for the surface roughness with a surface roughness measuring apparatus. The arithmetic average roughness Ra defined by JIS B0601 was 0.005 μm, and the mean spacing of the profile elements RSm also defined by JIS B0601 was 11 μm, indicating that the copper film surface had been flattened. Next, electroplating was conducted to form a copper film as shown in FIG. 3E as the metal film 2. The electroplating was conducted by using the composition of the plating bath and the plating conditions which were the same as Example 1.

When the cross section of the substrate was observed after the electroplating, the maximum thickness of the plated copper film of the area formed with the surface irregularities was 10 μm, and the maximum thickness of the plated copper film of the area formed with no surface irregularities was 0.5 μm, and the ratio H1/H2 of the film thickness shown in FIG. 12 was 20. As indicated by such results, a metal structure having a metal film preferentially formed in the area provided with the surface irregularities could be produced.

EXAMPLE 4

Figure 4A:
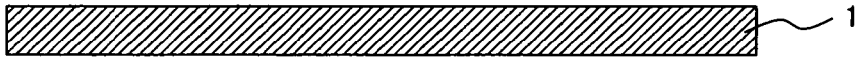
FIGS. 4A to 4D are cross sectional views showing the production method of the metal structure according to a still further embodiment of the present invention.
Figure 4B:
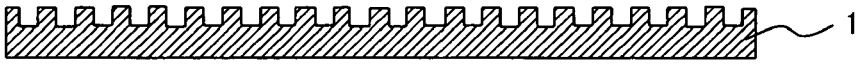

A copper foil having a thickness of 18 μm was used for the electrical conductor substrate as shown in FIG. 4A. The entire surface of the electrical conductor substrate was roughened to form the surface irregularities as shown in FIG. 4B. The roughening was conducted by using MultiBond manufactured by Nippon MacDermid Co., Ltd., and by the procedure shown in Table 2. Exemplary other copper roughening solutions that can be used include MECetchBOND manufactured by MEC Company Ltd., Circubond manufactured by Shipley Far East Ltd., and AlphaPREP manufactured by Alpha Metals Japan Ltd.

TABLE 2

| Step | Treating solution | Temperature (° C.) | Time (Sec.) |
|---|---|---|---|
| 1 | 5 vol % sulfuric acid | 25 | 30 |
| 2 | Pure water (running water) | 22 | 60 |
| 3 | 20 vol % MB-100B<br>2.9 vol % MB-100C | 25 | 30 |
| 4 | 5 vol % sulfuric acid<br>15 vol % MB-100A<br>2 vol % MB-100B<br>2.9 vol % MB-100C | 32 | 15 |
| 5 | Pure water (running water) | 22 | 60 |

Figure 4C:
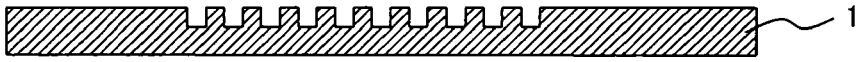
Figure 4D:
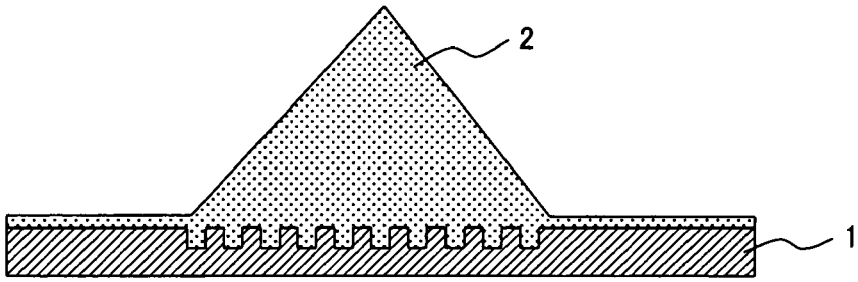

The roughened copper foil surface was evaluated for the surface roughness with a surface roughness measuring apparatus. The arithmetic average roughness Ra defined by JIS B0601 was 0.5 μm, and the mean spacing of the profile elements RSm also defined by JIS B0601 was 1.3 μm. Next, as shown in FIG. 4C, the surface irregularities were flattened except for the area that was to be covered by the metal film by electroplating. The flattening was conducted by covering the area with a solution containing copper fine particles by screen printing, and annealing the particles in vacuum at 350° C. for 30 minutes. The part printed with the copper fine particles was evaluated for the surface roughness with a surface roughness measuring apparatus. The arithmetic average roughness Ra defined by JIS B0601 was 0.005 μm, and the mean spacing of the profile elements RSm also defined by JIS B0601 was 11 μm, indicating that the copper film surface had been flattened. Next, electroplating was conducted to form the copper film and produce the metal structure as shown in FIG. 4D. The electroplating was conducted by using the composition of the plating bath and the plating conditions which were the same as those used in Example 1.

When the cross section of the substrate was observed after the electroplating, the maximum film thickness of the area formed with the surface irregularities was 10 μm, and the maximum thickness of the plated copper film of the area formed with no surface irregularities was 0.4 μm, and the ratio H1/H2 of the film thickness shown in FIG. 12 was 25. As indicated by such results, a metal structure having a metal film preferentially formed in the area provided with the surface irregularities could be formed.

EXAMPLE 5

Figure 5A:
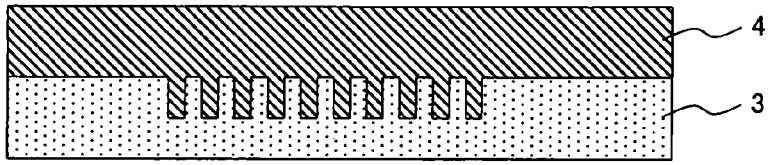
FIGS. 5A to 5D are cross sectional views showing the production method of the metal structure according to a still further embodiment of the present invention.
Figure 5B:
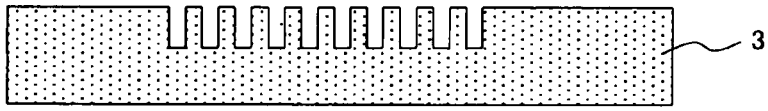

An epoxy resin plate was used for the electric insulator substrate 3, and surface irregularities were formed as shown in FIG. 5A by pushing the silicon mold 4 against the surface of the electric insulator substrate 3. The silicon mold 4 had a wiring pattern with a width of 50 μm formed at an interval of 5 μm as shown in FIG. 1A, and each wiring pattern had ridges having a width of 250 nm and a height of 400 nm formed at an interval of 250 nm formed to a width of 10 μm. By pressing the mold against the electric insulator substrate that had been heated to a temperature near the glass transition temperature, the electric insulator substrate 3 could be softened and deformed to replicate the shape of the mold 4. After cooling the electric insulator substrate 3 and the mold 4 to 25° C., the electric insulator substrate 3 was peeled off the mold 4 to produce the electric insulator substrate as shown in FIG. 5B.

Figure 5C:
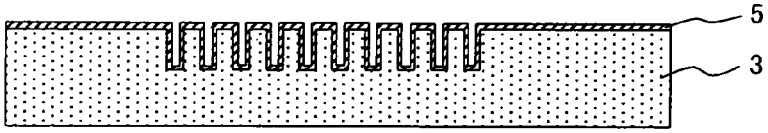

Next, a nickel/chromium film having a ratio of nickel to chromium of 1:1 was formed on the surface of the electric insulator substrate 3 to a thickness of 10 nm, and on the nickel/chromium film was formed a copper film of 100 nm by chemical vapor deposition. The electric insulator substrate having the nickel/chromium film and the copper film formed is shown in FIG. 5C. In FIG. 5C, the nickel/chromium film and the copper film are together referred to as the electrical conductor 5. The surface irregularities after forming the electrical conductor 5 was observed, and the shape of the surface irregularities of the electric insulator substrate 3 were found to be maintained by the electrical conductor 5. Immediately after forming the electrical conductor 5, electroplating was conducted to form the copper film. The electroplating was conducted by using the composition of the plating bath and the plating conditions which were the same as those used in Example 1.

The maximum thickness of the plated copper film in the area formed with the surface irregularities was 10 μm, and the maximum thickness of the plated copper film of the area formed with no surface irregularities was 0.3 μm, and the ratio H1/H2 of the film thickness shown in FIG. 12 was 33. As indicated by such results, a metal structure having a metal film preferentially formed in the area provided with the surface irregularities could be formed.

EXAMPLE 6

Figure 6A:
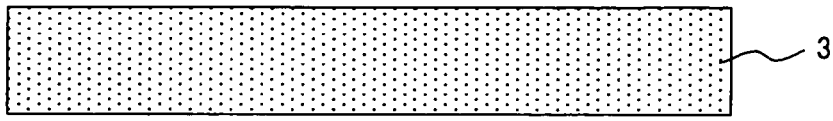
FIGS. 6A to 6D are cross sectional views showing the production method of the metal structure according to a still further embodiment of the present invention.
Figure 6B:
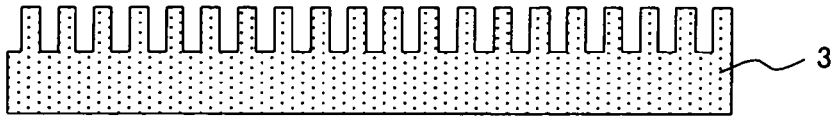

A polyimide resin film having a thickness of 25 μm was used for the electric insulator substrate. The surface of the electric insulator substrate 3 shown in FIG. 6A was roughened to form surface irregularities as shown in FIG. 6B. The roughening was conducted by the steps as shown in Table 3. The treating solution used in the roughening is not limited to the mixture of the potassium permanganate and the sodium hydroxide, and exemplary other solutions include a mixed solution of chromic acid and sulfuric acid, and a mixed solution of chromic acid and fluoroboric acid.

TABLE 3

| Step | Treating solution | Temperature (° C.) | Time (Sec.) |
|---|---|---|---|
| 1 | 50 g/dm$^3$ potassium permanganate<br>1 mol/dm$^3$ sodium hydroxide | 80 | 5 |
| 2 | 0.5 vol % sulfuric acid<br>0.2 vol % hydroxylamine sulfate | 40 | 5 |

Figure 6C:
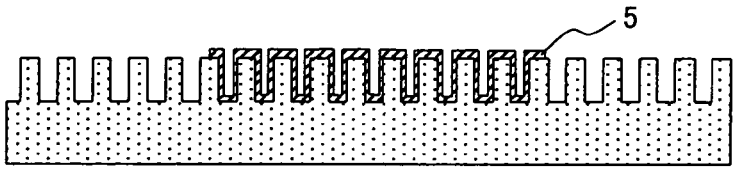
Figure 6D:
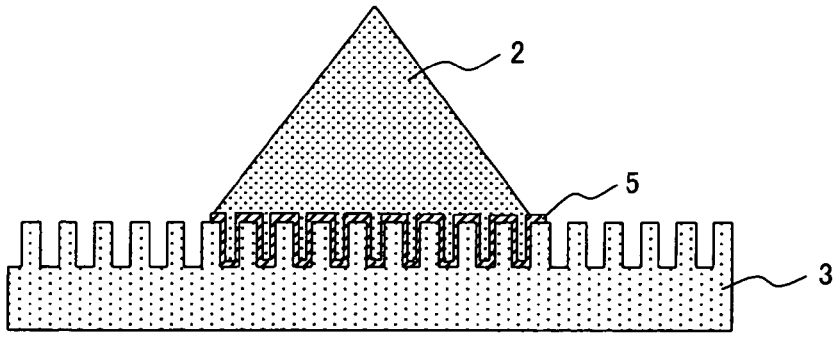

The surface irregularities of the polyimide film after the roughening were evaluated with a surface roughness measuring apparatus. The arithmetic average roughness Ra defined by JIS B0601 was 2.0 μm, and the mean spacing of the profile elements RSm also defined by JIS B0601 was 4.0 μm. Next, a electrical conductor 5 having a wiring width of 10 μm was formed on a part of the electric insulator substrate 3 by sputtering through a mask. The electrical conductor 1 comprises a laminate of nickel film having a thickness of 0.01 μm and a copper film having a thickness of 0.5 μm formed on the nickel film. The electrical conductor 5 is not limited to such laminate of the nickel and copper films, and another example of such electrical conductor is a laminate of chromium and copper films. FIG. 6C shows the electrical conductor 5 formed on the electric insulator substrate 3. The surface irregularities after forming the electrical conductor 5 were evaluated with a surface roughness measuring apparatus. The arithmetic average roughness Ra defined by JIS B0601 was 2.0 μm, and the mean spacing of the profile elements RSm also defined by JIS B0601 was 4.0 μm, indicating that the shape of the surface irregularities of the electric insulator substrate 3 had been maintained.

Immediately after forming the electrical conductor 5, electroplating was conducted to form the plated copper film. The electroplating was conducted by using the composition of the plating bath and the plating conditions, which is the same as those used in Example 1. The maximum thickness of the plated copper film in the area formed with the surface irregularities was 15 μm, and the copper film was preferentially plated in the area formed with the electrical conductor 5. The ratio H1/H2 of the film thickness shown in FIG. 12 was 27. As indicated by such results, a metal structure having a metal film preferentially formed in the area provided with the surface irregularities could be produced.

EXAMPLE 7

Figure 7A:
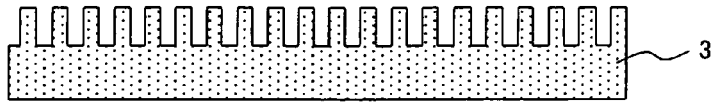
FIGS. 7A to 7E are cross sectional views showing the production method of the metal structure according to a still further embodiment of the present invention.
Figure 7B:
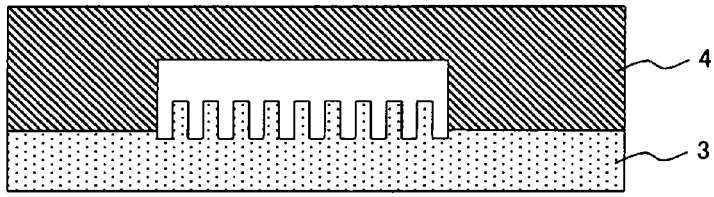

Polyamic acid was applied on a copper foil having surface irregularities with the arithmetic average roughness Ra defined by JIS B0601 of 1.0 μm and mean spacing of the profile elements RSm also defined by JIS B0601 of 1.1 μm, and the foil was heated to produce a polyimide film. The copper foil was then removed by etching with a solution containing sulfuric acid and hydrogen peroxide to produce the electric insulator substrate 3 as shown in FIG. 7A. The electric insulator substrate 3 had a surface roughness with the arithmetic average roughness Ra defined by JIS B0601 of 1.0 μm and the mean spacing of the profile elements RSm also defined by JIS B0601 of 1.1 μm. Next, as shown in FIG. 7B, a silicon mold 4 provided with a groove having a width of 10 μm was pressed against the electric insulator substrate 3 that had been heated to a temperature near the glass transition temperature with the temperature maintained during the pressing, and avoiding the groove portion of the mold 4 from being brought in contact with the electric insulator substrate 3.

Figure 7C:
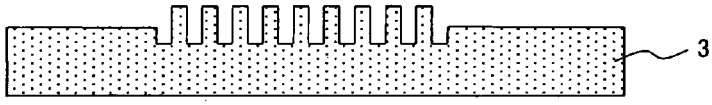
Figure 7D:
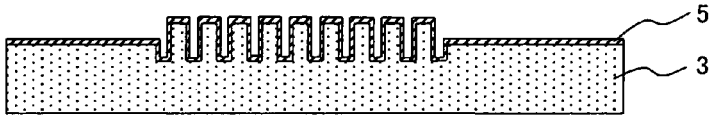
Figure 7E:
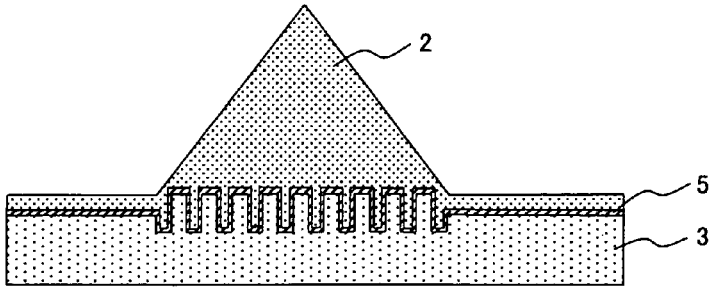

Next, the electric insulator substrate 3 and the mold 4 were cooled to 25° C., and they were separated from each other by peeling to produce the electric insulator substrate 3 as shown in FIG. 7C having a part of its surface flattened. When the surface roughness of the flattened part was measured by a surface roughness surface roughness measuring apparatus, the arithmetic average roughness Ra defined by JIS B0601 was 0.006 μm, and the mean spacing of the profile elements RSm also defined by JIS B0601 was 9 μm. Next, a film of 10 nm comprising chromium and nickel at a ratio of 1:1 was formed on the electric insulator substrate 3 by sputtering, and on this chromium/nickel film was formed a copper film of 100 nm by vapor deposition. FIG. 7D shows the electric insulator substrate 3 having a laminate of the nickel/chromium film and the copper film deposited on the electric insulator substrate 3 in the area having the surface irregularities. The surface irregularities were evaluated for their roughness, and the arithmetic average roughness Ra defined by JIS B0601 was 1.0 μm, and the mean spacing of the profile elements RSm also defined by JIS B0601 was 1.1 μm, indicating that the shape of the surface irregularities of the electric insulator substrate 3 had been maintained.

Immediately after forming the electrical conductor 5, electroplating was conducted to form the copper film. The electroplating was conducted by using the composition of the plating bath and the plating conditions which were the same as those used in Example 1. The maximum thickness of the plated copper film in the area formed with the surface irregularities was 10 μm, and the maximum thickness of the plated copper film of the area formed with no surface irregularities was 0.33 μm, and the ratio H1/H2 of the film thickness shown in FIG. 12 was 30. As indicated by such results, a metal structure having a metal film preferentially formed in the area provided with the surface irregularities could be produced.

EXAMPLE 8

Figure 8A:
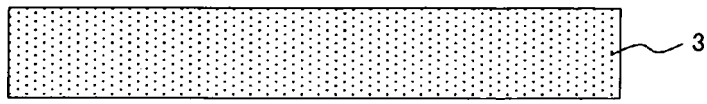
FIGS. 8A to 8E are cross sectional views showing the production method of the metal structure according to a still further embodiment of the present invention.
Figure 8B:
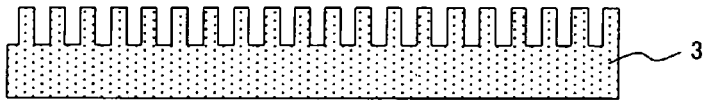
Figure 8C:
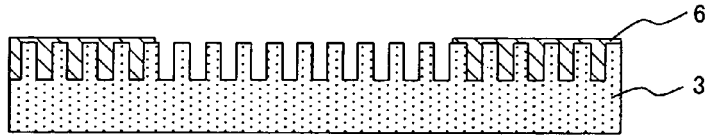

An electric insulator substrate 3 comprising polyimide resin was used. Surface of the polyimide resin as shown in FIG. 8A was roughened by using a mixed solution of chromic acid and sulfuric acid to form the surface irregularities as shown in FIG. 8B. When the surface roughness of the area formed with the surface irregularities was measured, the arithmetic average roughness Ra defined by JIS B0601 was 1.2 μm, and the mean spacing of the profile elements RSm also defined by JIS B0601 was 0.8 μm. Next, as shown in FIG. 8C, the electric insulator substrate 3 was partly covered with an electric insulator 6 comprising a photocurable resin by screen printing, and the resin was cured to flatten the surface irregularities. When the area where the surface irregularities had been flattened by filling the resin was evaluated for the surface roughness, the arithmetic average roughness Ra defined by JIS B0601 was 0.006 μm, and the mean spacing of the profile elements RSm also defined by JIS B0601 was 9 μm.

Figure 8D:
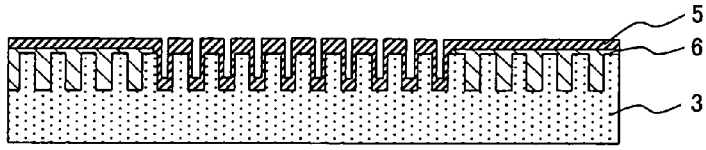

Next, a nickel/chromium film having a nickel to chromium ratio of 1:1 was formed to a thickness of 10 nm by sputtering on the electric insulator substrate 3 in the area having the surface irregularities, and a copper film of 100 nm was then formed on the nickel/chromium film by vapor deposition to thereby form the electrical conductor 5 comprising the nickel/chromium film and the copper film as shown in FIG. 8D. When the surface irregularities after the forming of the electrical conductor 5 were evaluated for the surface roughness, the arithmetic average roughness Ra defined by JIS B0601 was 1.2 μm, and the mean spacing of the profile elements RSm also defined by JIS B0601 was 0.8 μm, indicating that the shape of the surface irregularities of the electric insulator substrate 3 had been maintained by the electrical conductor 5.

Figure 8E:
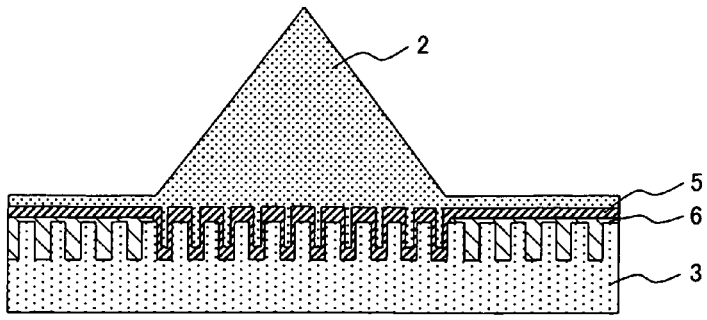

Immediately after forming the electrical conductor 5, electroplating was conducted to form the plated copper film as shown in FIG. 8E. The electroplating was conducted by using the composition of the plating bath and the plating conditions which were the same as those used in Example 1. Maximum thickness of the plated copper film in the area formed with surface irregularities was 15 μm, and 0.55 μm in the area formed with no surface irregularities. The ratio H1/H2 of the film thickness shown in FIG. 12 was 27. As a consequence, a metal structure having a metal film could be preferentially formed in the area provided with the surface irregularities.

EXAMPLE 9

Figure 9A:
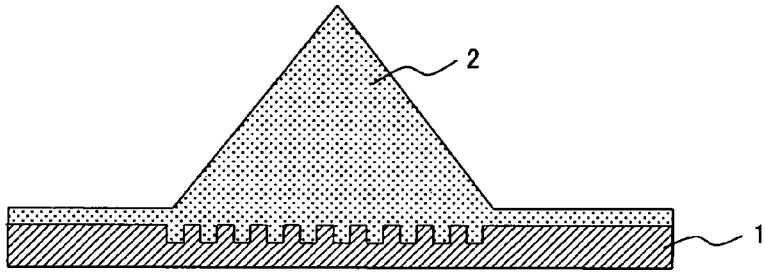
FIGS. 9A and 9B are cross sectional views showing the production method of the metal structure according to a still further embodiment of the present invention.
Figure 9B:
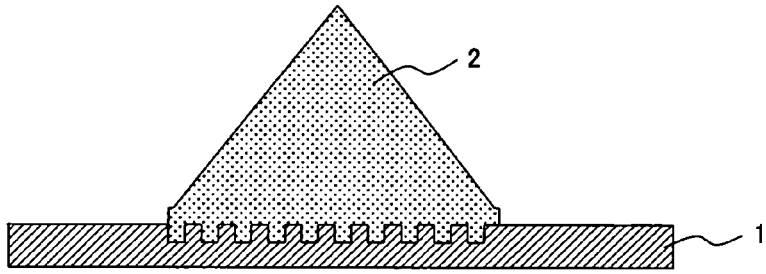

A metal structure having the configuration of FIG. 9A was produced by repeating the procedure of Example 1 except that the substance used was the one indicated in Table 4. Next, the copper film of the part having no surface irregularities was removed by using a copper etchant (MECBRITE manufactured by MEC Company Ltd.) to thereby produce the cross section as shown in FIG. 9B. As a consequence, a metal structure comprising the nickel film and the overlying plated copper film could be produced.

EXAMPLE 10

Figure 5D:
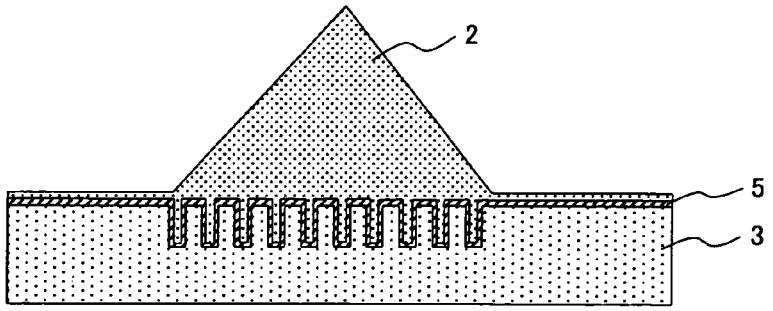
Figure 10A:
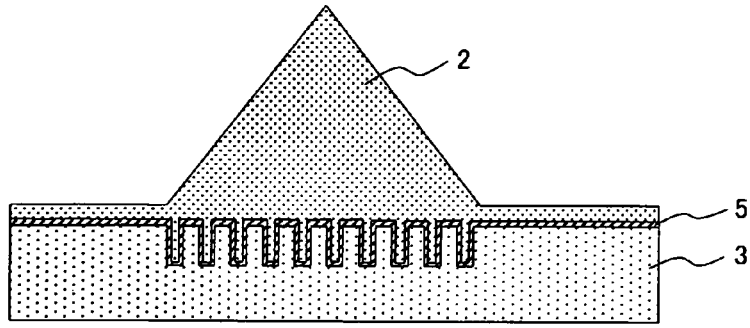
FIGS. 10A to 10C are cross sectional views showing the production method of the metal structure according to a still further embodiment of the present invention.
Figure 10B:
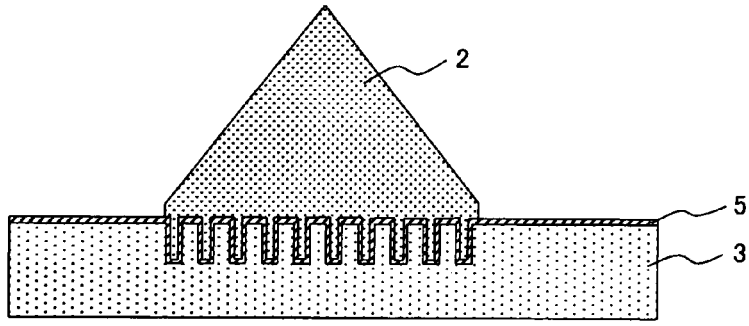
Figure 10C:
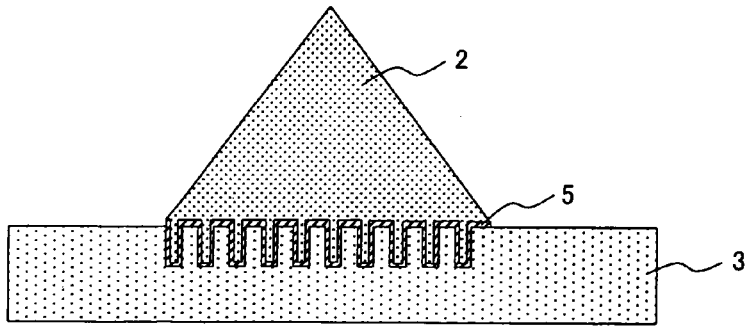

A metal structure was produced by repeating the procedure of Example 1 except that the additive used was the one indicated in Table 4. Cross section of the metal substrate is shown in FIG. 10A, which is the same as FIG. 5D. Next, the copper film in the area having no surface irregularities was removed by using an aqueous solution containing sulfuric acid and hydrogen peroxide to realize the state as shown in FIG. 10B. The electrical conductor 5 comprising the nickel/chromium film and the copper film was removed by using an aqueous solution containing potassium permanganate to realize the state as shown FIG. 10C. As a consequence, a metal structure could be produced in the predetermined part of the electric insulator substrate having the surface irregularities.

EXAMPLE 11

Figure 11A:
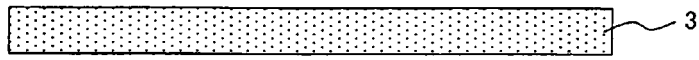
FIGS. 11A to 11C are cross sectional views showing the production method of the metal structure according to a still further embodiment of the present invention.
Figure 11B:
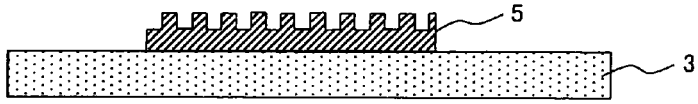
Figure 11C:
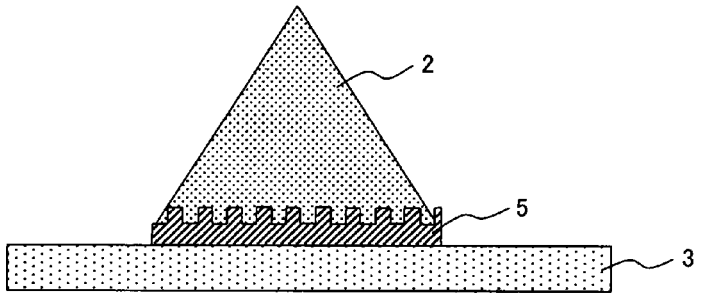

On the electric insulator substrate 3 comprising the glass substrate shown in FIG. 11A was printed a dispersion of silver fine particles having an average particle size of 5 nm by ink jet printing as shown in FIG. 11B to form a electrical conductor 5 comprising a silver film having a wiring width of 20 μm and a thickness of 0.2 μm. The electric insulator substrate 3 was then heated to a temperature of 300° C. for fusion of silver fine particles. The surface irregularities on the silver film surface formed by the silver fine particles were evaluated with a surface roughness measuring apparatus. The arithmetic average roughness Ra defined by JIS B0601 was 0.01 μm, and the mean spacing of the profile elements RSm also defined by JIS B0601 was 0.02 μm.

Immediately after forming the silver film, electroplating was conducted to form the copper film as the metal film 2. The electroplating was conducted by using the composition of the plating bath and the plating conditions which were the same as those used in Example 1. When the cross section of the substrate was observed after the electroplating, the plated film developed in vertical direction only in the area formed with the surface irregularities, and no growth in the horizontal direction was found. As a consequence, a metal structure having the metal film only in the area of predetermined pattern having the surface irregularities could be produced.

COMPARATIVE EXAMPLE 1

A metal structure was produced by repeating the procedure of Example 2 except that the roughening was not conducted. When the cross section of the substrate was observed, preferential growth of the plating film had not taken place, and the ratio H1/H2 of the film thickness shown in FIG. 12 was 1.0. In this Comparative Example, a metal structure could not be formed in the predetermined pattern.

TABLE 4

| No. | Ra of the surface irregularities | RSm of the surface irregularities | Kind of the additive | Concentration of the additive (mg/dm$^3$) | Current density (A/dm$^2$) | H1/H2 |
|---|---|---|---|---|---|---|
| Ex. 1 | 0.15 | 0.6 | A-2 | 7.0 | 1.3 | 78 |
| Ex. 2 | 0.4 | 1.1 | A-2 | 7.0 | 0.5 | 150 |
| Ex. 3 | 0.05 | 0.04 | A-2 | 7.0 | 1.3 | 20 |
| Ex. 4 | 0.5 | 1.3 | A-2 | 7.0 | 1.3 | 25 |
| Ex. 5 | 0.2 | 0.5 | A-2 | 7.0 | 1.3 | 33 |
| Ex. 6 | 2.0 | 4.0 | A-2 | 7.0 | 1.3 | 27 |
| Ex. 7 | 1.0 | 1.1 | A-2 | 7.0 | 1.3 | 30 |
| Ex. 8 | 1.2 | 0.8 | A-2 | 7.0 | 1.3 | 27 |
| Ex. 9 | 0.15 | 0.6 | A-1 | 3.0 | 1.3 | 77 |
| | | | A-4 | 3.0 | | |
| Ex. 10 | 0.2 | 0.5 | A-2 | 7.0 | 1.3 | 64 |
| | | | B | 100 | | |
| | | | C | 2 | | |
| Ex. 11 | 0.01 | 0.02 | A-2 | 7.0 | 1.3 | — |
| Comp. Ex. 1 | 0.007 | 10 | A-2 | 7.0 | 1.3 | 1.0 |

The symbols used in the column of the "Type of the additive" in Table 4 stand for the following chemical substances.

A-1:

2-[(1,3-dihydro-1,3,3-trimethyl-2H-indol-2-ylidene)-methyl]-1,3,3-trimethyl-3H-indolium perchlorate

A-2:

2-[3-(1,3-dihydro-1,3,3-trimethyl-2H-indol-2-ylidene)-1-propenyl]-1,3,3-trimethyl-3H-indolium chloride

A-3:

2-[5-(1,3-dihydro-1,3,3-trimethyl-2H-indol-2-ylidene)-1,3-pentadienyl]-1,3,3-trimethyl-3H-indolium iodide

A-4:

2-[7-(1,3-dihydro-1,3,3-trimethyl-2H-indol-2-ylidene)-1,3,5-heptatrienyl]-1,3,3-trimethyl-3H-indolium iodide B: polyethylene glycol (average molecular weight, 2000)

C: bis(3-sulfopropyl) disulfide

The present invention enables formation of a metal body or film of fine pattern at a predetermined position without using any resist mask, and therefore, it can be used in producing an optical component, stamper used as a mold, an inspection probe, a micromachine, and the like. The present invention can also be used in producing various components, for example, to impart the component with water repellency or to alter the appearance. The applicability of this invention is unlimited.

What is claimed is:

1. A method for producing a metal structure comprising a substrate and a metal body formed on the substrate; comprising the steps of:

providing a substrate, at least an upper surface of which comprises an electrical conductor with an area having irregularities and an area not having the irregularities, wherein the area having irregularities has an arithmetic average roughness Ra of 0.05-2.0 μm defined by JIS B0601:2001 and has a mean spacing of the profile elements RSm of 0.04-4.0 μm defined by JIS B0601:2001; and forming a metal body on said electrical conductor by electroplating using a plating bath comprising the metal to be plated and a cyanine dye for suppressing a plating reaction, wherein the cyanine dye loses a plating suppressing effect with the progress of the plating reaction and wherein a preferential growth of the metal body is facilitated on the area having irregularities, thereby a ratio of a thickness of the metal body on the area having irregularities to a thickness of the metal body on the area not having the irregularities is 10 or more, and the thickness of the metal body on the area not having the irregularities is 0.55 μm or less.

2. The method for producing a metal structure according to claim 1, wherein the substrate is formed of an electro-electrical conductor.

3. The method for producing a metal structure according to claim 1, wherein the substrate comprises of an electric insulator having irregularities formed on a surface thereof, and the electrical conductor deposited on the substrate with the shape of the irregularities maintained.

4. The method for producing a metal structure according to claim 1, wherein the substrate is formed from a electrical conductor having the area having the irregularities formed on a portion of the substrate, and having the area not having the irregularities on another, flattened area.

5. The method for producing a metal structure according to claim 3, wherein the surface of the substrate and the electrical conductor other than the area having the irregularities is flattened.

6. The method for producing a metal structure according to claim 1, further comprising, after forming the metal body preferentially by electroplating on the substrate in the area having irregularities, the metal body formed on the area not having the irregularities is removed.

7. The method for producing a metal structure according to claim 6, further comprising, after removing the metal body formed on the area not having the irregularities, the electrical conductor formed in the area not having the irregularities is removed.

8. The method for producing a metal structure according to claim 1, wherein the ratio of the thickness of the metal body in the area having irregularities to the thickness of the metal body formed in the area having not having the irregularities is greater than 10.

9. The method for producing a metal structure according to claim 1, wherein the area having irregularities has an arithmetic average roughness Ra defined by JIS B0601:2001 greater than that of the area not having the irregularities.

10. The method for producing a metal structure according to claim 1, wherein the area having irregularities has a mean spacing of the profile elements RSm defined by JIS B0601:2001 smaller than that of the area not having the irregularities.

11. The method for producing a metal structure according to claim 1, wherein the metal to be plated is copper or an alloy thereof.

12. The method for producing a metal structure according to claim 1, wherein the cyanine dye is a compound represented by the following chemical structure:

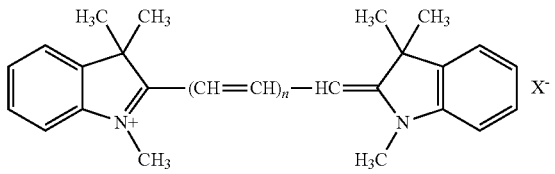

wherein X is an anion, and n is any one of 0, 1, 2 and 3.

13. The method for producing a metal structure according to claim 1, wherein the ratio of the thickness of the metal body in the area having irregularities to the thickness of the metal body formed in the area having not having the irregularities is greater than 100.

14. A method for producing a metal structure comprising a substrate and a metal body formed on the substrate; comprising the steps of:

providing a substrate, at least an upper surface of which comprises an electrical conductor with an area having irregularities and an area not having the irregularities, wherein the area having irregularities has an arithmetic average roughness Ra of 0.05-2.0 μm defined by JIS B0601:2001 and has a mean spacing of the profile elements RSm of 0.04-4.0 μm defined by JIS B0601:2001;

providing a plating bath comprising a metal to be plated on the electrical conductor and a cyanine dye for suppressing a plating reaction, wherein the cyanine dye loses a plating suppressing effect with the progress of the plating reaction such that a preferential growth of a metal body is facilitated on the area having irregularities;

forming a metal body on said electrical conductor by electroplating using the plating bath; and continuing formation of the metal body on the electrical conductor by electroplating using the plating bath until a ratio of a thickness of the metal body on the area having irregularities to a thickness of the metal body on the area not having the irregularities is 10 or more, and the thickness of the metal body on the area not having the irregularities is 0.55 μm or less.

15. The method for producing a metal structure according to claim 14, wherein the substrate is formed of an electro-electrical conductor.

16. The method for producing a metal structure according to claim 14, wherein the substrate comprises of an electric insulator having irregularities formed on a surface thereof, and the electrical conductor deposited on the substrate with the shape of the irregularities maintained.

17. The method for producing a metal structure according to claim 16, wherein the surface of the substrate and the electrical conductor other than the area having the irregularities is flattened.

18. The method for producing a metal structure according to claim 14, wherein the substrate is formed from a electrical conductor having the area having the irregularities formed on a portion of the substrate, and having the area not having the irregularities on another, flattened area.

19. The method for producing a metal structure according to claim 14, further comprising, after forming the metal body preferentially by electroplating on the substrate in the area having irregularities, the metal body formed on the area not having the irregularities is removed.

20. The method for producing a metal structure according to claim 19, further comprising, after removing the metal body formed on the area not having the irregularities, the electrical conductor formed in the area not having the irregularities is removed.

21. The method for producing a metal structure according to claim 14, wherein the ratio of the thickness of the metal body in the area having irregularities to the thickness of the metal body formed in the area having not having the irregularities is greater than 10.

22. The method for producing a metal structure according to claim 14, wherein the area having irregularities has an arithmetic average roughness Ra defined by JIS B0601:2001 greater than that of the area not having the irregularities.

23. The method for producing a metal structure according to claim 14, wherein the area having irregularities has a mean spacing of the profile elements RSm defined by JIS B0601:2001 smaller than that of the area not having the irregularities.

24. The method for producing a metal structure according to claim 14, wherein the metal to be plated is copper or an alloy thereof.

25. The method for producing a metal structure according to claim 14, wherein the cyanine dye is a compound represented by the following chemical structure:

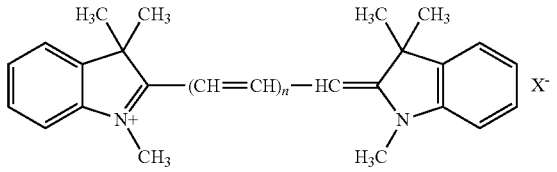

wherein X is an anion, and n is any one of 0, 1, 2 and 3.

26. The method for producing a metal structure according to claim 14, wherein the ratio of the thickness of the metal body in the area having irregularities to the thickness of the metal body formed in the area having not having the irregularities is greater than 100.

27. The method for producing a metal structure according to claim 14, wherein the area having irregularities has an arithmetic average roughness Ra of 0.1-1.0 μm defined by JIS B0601:2001 and has a mean spacing of the profile elements RSm of 0.05-2.0 μm defined by JIS B0601:2001.

28. The method for producing a metal structure according to claim 1, wherein the area having irregularities has an arithmetic average roughness Ra of 0.1-1.0 μm defined by JIS B0601:2001 and has a mean spacing of the profile elements RSm of 0.05-2.0 μm defined by JIS B0601:2001.

* * * * *